US009126087B2

(12) United States Patent
Salway

(10) Patent No.: US 9,126,087 B2
(45) Date of Patent: Sep. 8, 2015

(54) ATHLETIC SKILL TRAINING DEVICE AND METHOD

(71) Applicant: John Salway, Fort Wayne, IN (US)

(72) Inventor: John Salway, Fort Wayne, IN (US)

( * ) Notice: Subject to any disclaimer, the term of this patent is extended or adjusted under 35 U.S.C. 154(b) by 98 days.

(21) Appl. No.: 14/038,264

(22) Filed: Sep. 26, 2013

(65) Prior Publication Data

US 2015/0087447 A1 Mar. 26, 2015

(51) Int. Cl.
*A63B 69/00* (2006.01)

(52) U.S. Cl.
CPC ..... *A63B 69/0024* (2013.01)

(58) Field of Classification Search
USPC ..... 473/446, 417, 427, 429; 248/71, 141, 248/146, 407, 423, 219.2–219.4, 520, 538; 403/71, 88, 195, 375, 388
See application file for complete search history.

(56) References Cited

U.S. PATENT DOCUMENTS

| | | | | | |
|---|---|---|---|---|---|
| 2,121,572 | A * | 6/1938 | Polden et al. | ..... | 351/153 |
| 2,645,439 | A * | 7/1953 | Gauthier | ..... | 248/513 |
| 2,748,955 | A * | 6/1956 | Anselmo | ..... | 211/204 |
| 3,734,439 | A * | 5/1973 | Wintz | ..... | 248/224.51 |
| 5,056,952 | A * | 10/1991 | Gringer | ..... | 403/96 |
| 5,231,785 | A * | 8/1993 | Roberts | ..... | 43/21.2 |
| 5,340,087 | A * | 8/1994 | Turner | ..... | 256/67 |
| 5,769,742 | A * | 6/1998 | Bristow | ..... | 473/446 |
| 6,089,524 | A * | 7/2000 | Lai | ..... | 248/535 |
| 7,811,183 | B1 * | 10/2010 | Ohle | ..... | 473/429 |
| 8,777,781 | B2 * | 7/2014 | Marks et al. | ..... | 473/429 |
| 2003/0054904 | A1 * | 3/2003 | Getchell | ..... | 473/446 |
| 2012/0178553 | A1 * | 7/2012 | Laird | ..... | 473/446 |

* cited by examiner

*Primary Examiner* — Mark Graham
(74) *Attorney, Agent, or Firm* — Jacque R. Wilson, Esq.; Carson Boxberger LLP

(57) ABSTRACT

A hockey skill training system, said system comprising a hockey stick having a transverse bore, a movable stand, and a skill training device, said skill training device comprising: a generally cylindrical external shape having a to surface, a bottom surface, a front, and a back, wherein the bottom surface comprises an open portion adapted for releasably rigidly connecting said bottom portion of said training device on top of the stand, and wherein the top surface is upwardly slanted from the front to the back.

9 Claims, 1 Drawing Sheet

Hockey Stick
Cone

Plateau

ATHLETIC SKILL TRAINING DEVICE AND METHOD

BACKGROUND

1. Field of the Art

The present invention relates generally to athletic training devices and methods. More specifically, the present invention relates to devices, systems, and methods for teaching particularized athletic skills in certain sports, such as hockey.

2. Description of the Prior Art

U.S. Pat. No. 5,249,797 discloses a hockey training aid and game apparatus includes a portable housing having a base unit and a cover connected to the base unit. The base unit includes a floor and four side walls. The floor contains indicia representing a hockey rink; and the cover includes brackets for retaining a collapsible hockey stick and a scoring and control assembly when the apparatus is transported. The stick is capable of being assembled into a functional hockey stick when the apparatus of the invention is used. A first sensor assembly is used for monitoring accurate puck handling. A scoring and control assembly is provided for scoring puck handling and includes a first counter assembly for counting monitored instances of accurate puck handling. A timer shuts off the first counter assembly after a predetermined time expires. A second sensor assembly may be employed for monitoring inaccurate puck handling. In this respect, the scoring and control assembly further includes a second counter assembly for counting monitored instances of inaccurate puck handling. The second counter assembly is also shut off by the timer after a predetermined time expires. A sounding device can sound when inaccurate puck handling is sensed by the second sensor assembly. The first sensor assembly, for measuring puck handling accuracy, includes a first puck sensor located in a center of the floor. The second sensor assembly, for measuring puck handling inaccuracy, can include a number of second puck sensors, or a ribbon of sensors, located along lines near side walls in the floor.

U.S. Pat. No. 5,356,135 discloses a reflex hockey/roller ball and street ball practice board which is compact and economical to build that tones the skills of a player at all levels of expertise from beginners to professionals. The board has a sensor which indicates by lights and/or a counter when the puck crosses the center line and encourages the player to increase their stick handling abilities. Also, goals are indicated by audio/visual means such as a bell or flashing lights. The wall structure includes a rebound material such as foam rubber and at least one wall includes an irregular surface for rebound un-predictability.

U.S. Pat. No. 5,470,067 discloses a sports practice device including a dispenser having a chamber for retaining at least one projectile. The chamber has a base for supporting the at least one projectile and an aperture for ejecting the at least one projectile. A mounting is attached to the dispenser, which detachably couples the dispenser to a shaft of a player held projectile propelling device. According to a preferred embodiment, the player held projectile propelling device can be a hockey stick and the projectile can be a puck or ball. A method of attaching a projectile dispenser to a player held projectile propelling device, inserting at least one projectile into the dispenser, releasing a projectile from the projectile dispenser, and impacting the projectile, is also provided.

U.S. Pat. No. 5,520,386 discloses an inverted U-shaped hockey stick weight training device comprises a bridge member integrally joined to two depending plates. The two plates frictionally engage the faces of the blade, conform to its curve and provide a uniform weight distribution throughout the entire length of the blade. A hole is formed in the bridge member with a tether running therethrough, securing the training device to the shaft of the hockey stick. The training device is made of a flexible, resilient plastic and can be manufactured in a variety of weights.

U.S. Pat. No. 5,769,742 discloses a mechanical athletic training device includes a mobile carriage with a locking device which locks the mobile carriage in a stationary position. An opponent simulator, such as a hockey stick, is connected to the mobile carriage by a pivoting connection. The mobile carriage combined with the pivoting connection allows the opponent simulator to interact with an athlete by simulating the movements and actions of a defensive or offensive player. The mobile carriage combined with the pivoting connection forces the athlete to anticipate the movements of the opponent simulator and play through the opponent simulator rather than around it. The opponent simulator can be activated manually by the athlete by striking the opponent simulator. Alternatively, the opponent simulator can be manually operated by an operator using a handle device attached to the pivoting connection. As a further alternative, an electric motor can be attached to the pivoting connection to automatically impart motion to the opponent simulator.

U.S. Pat. No. 5,816,945 discloses a hockey training device comprising a leader having a swivel attached to one end thereto permit rotation of leader without twisting of the leader and a stop attached to second end of the leader for securing the leader to a hockey puck to enable a person to practice puck handling, a looped member connected to the swivel, a strap having a hook and loop type fastener for releasably securing the strap to a hockey stick and an elastic member having a first end secured to the strap and a second end secured to the split ring for absorbing shocks.

U.S. Pat. No. 6,012,994 discloses an ice hockey training dummy adapted to be installed onto a playing field to simulate the presence of either a teammate or an adverse party player and comprising in combination a generally flat body having a general outline of a player and attached at its lower part to a support via cylindrical spring clips, the support maintaining the dummy support to maintain the dummy in upright position. One hand of the dummy is built in the body while the second lower hand extends out from said body. The upper part of a hockey stick is built in the body and extends between both hands. The lower freely protruding part of the hockey stick is attached to the dummy via a spring link allowing enough flexibility for the stick lower part to be slightly deflected about the spring link when hit.

U.S. Pat. No. 6,099,420 discloses a portable hockey practice system for increasing a hockey player's skill in shooting and catching a hockey puck along with developing quicker and better reflexes. The inventive device preferably includes three track sections each having a slot, a plurality of connecting members that connect the three track sections with conventional fasteners, a first end plate and a second end plate at opposing ends of the connected track sections, a first spring and a second spring attached to opposing end plates, and a puck attached to spacer slidably positioned within the slot of the connected track sections. The user engages the puck with a conventional hockey stick driving the puck towards the first spring. The first spring rebounds the puck towards the user. The user has the option of either catching the puck or letting the puck pass through where after it engages the second spring that rebounds the puck back to the user to stop with their back hand motion. The user can adjust the velocity of the puck rebounding from the first spring by adjusting the adjusting bolt that retains the first spring semi-compressed.

U.S. Pat. No. 6,165,084 discloses a hockey training device comprising a frame with skate-like and hockey stick-like members attached thereto, simulating an opposing player. This training device is intended to assist the novice hockey player in developing the skills associated with maneuvering the hockey puck around and/or through an opponent, and forces the novice to concentrate on the triangle presented by the skates and hockey stick of the opponent. The device consists of a frame supporting two downwardly disposed legs having skate-like elements attached, and a third leg having a stick-like element attached. The skate-like elements and stick-like elements have coplanar lower edges so that the entire device may be placed on the ice, resting on these edges. The frame may be weighted, and drag-inducing spikes may be incorporated into the skate-like elements to affect the motion of the device on the ice.

U.S. Pat. No. 6,174,248 discloses a hockey stick training device to be attached to the shaft of a hockey stick includes a shield and a connector. The shield blocks a player's view of most of the blade of the hockey stick when the player carries the hockey stick forcing the player to rely on feel to handle and/or shoot rather than by sight.

U.S. Pat. No. 6,186,904 discloses a weighted sport training assembly used to overload the muscles while making sport specific movements during sport training. The principle can be applied to several sports implements such as a golfclub, a tennis or squash racquet, hockey stick, baseball bat, and other similar sports devices. The Golf Swing Training Club is an assembly of golfclub pieces and weights combined to offer an individual training a golf swing, or performing exercises that are either technical in nature, or fitness related, the opportunity to change the shape, length, or weight of the club by adding an extension shaft and inserting a variety of weights into the assembly.

U.S. Pat. No. 6,290,619 discloses a street hockey ball for use in games on hard surfaces. The ball has a core of a low rebound material, and a hard, tough covering material. This invention provides for the height of contact between the ball and the stick to approximate the height of contact between the hockey puck and the stick, and the weight of the ball is likewise designed to approximate a puck. In this way the ball of the present invention simulates the feel and action of a hockey puck, for example providing ice hockey players with a viable training device off the ice.

U.S. Pat. No. 6,328,666 discloses an adjustable hockey stick weight (known commercially as 'THE ORIGINAL STICK WEIGHT'®) which is a training device designed for quick attachment to and removal from hockey sticks (ice or roller). It is used exclusively for practice, warm-ups, or training. The totally adjustable hockey stick weight is manufactured from aircraft aluminum: 6061/6063 T-5 or any comparable grades thereof. The aluminum itself can be machined from raw billets or drawn through a die into the specifically designed shapes of the wide variety of the adjustable hockey stick weight(s) themselves holding their controlled, fixed dimensions. The totally adjustable hockey stick weight comprises of two main components: a main body, and a face plate. It is manufactured (as mentioned previously) in a variety of sizes, shapes, and weights. In addition, all the various shapes and sizes adhere to the integrity and configuration of the original design. The face plates with their standard 'V'-groove are held in place against the 'U'-shaped main body through the use of two thumb screws.

U.S. Pat. No. 6,335,756 discloses a miniature videoprobe system having a probe termination box, a strong back, and a videoprobe housing. The videoprobe system is able to obtain images from a restricted space at least as small as 0.125" while producing a high quality image. The strong back has a hockey stick shape with the probe termination box connecting to the top of the handle-like portion of the hockey stick and the videoprobe housing attaching to the opposite end or nose of the hockey stick shape. The videoprobe housing has a roughly arrowhead shape with two thin steel plates sandwiching the internal components there between. The internal components are connected in series to allow for a minor dimension of the videoprobe housing of 0.110". The internal components include an optics train, a CCD chip, and an electronics package. An electrical signal is transmitted from the electronics package through wiring within an internal channel of the strong back to the probe termination box. The strong back has milled into it multiple internal channels for facilitating the transfer of information, items, or devices between the probe termination box and the videoprobe housing.

U.S. Pat. No. 6,364,790 discloses a hockey practice apparatus comprises a thin mat member having a length and a width each substantially greater than its thickness, a generally centrally disposed longitudinal axis extending along its length, and including a bottom stratum presenting a slippage precluding bottom surface and a top stratum adjoined to the bottom stratum and presenting a low friction substantially planar top surface for receiving a hockey puck in free sliding relation thereon. A method of teaching hockey skills comprising the steps of providing a practice surface for receiving a hockey puck thereon; initially placing a visual target adjacent the practice surface so as to be viewable concurrently with the practice surface by a practising player standing beside the practice surface and stickhandling the puck with a hockey stick, thereby encouraging the practicing player to look at the visual target while stickhandling the puck with a hockey stick; and, subsequently moving the visual target to a superior position in the practising player's field of view, thereby encouraging the practising player to look up while stickhandling the puck with a hockey stick.

U.S. Pat. No. 6,569,041 discloses a device for significantly enhancing the ability of ice hockey players of all experience levels for developing stick control and correct shooting movements while also increasing strength, balance and accuracy thereof which includes a framework defining a practice zone thereunder wherein a flexibly resilient member is secured to uniquely configured apertures defined in the blade of the training hockey stick to encourage correct stick movement and to discourage incorrect stick handling and shooting movements. The apertures are preferably located in the heel, the toe and/or the tip of the blade of the stick and are attached to the resilient member for building up strength and providing resistance thereto. The resilient member is knotted and positioned extending through one or more of the apertures in the stick blade and the apertures are shaped such as to retain the knot of the stick extending through the aperture responsive to correct stick movements and to release the knot responsive to incorrect stick movements. This teaching mechanism is achieved by forming apertures which includes a wider area on the tip side of the aperture and including narrow or more restricted areas on the heel part of the apertures.

U.S. Pat. No. 6,716,120 discloses a hockey training aid including a blade having a shank for inserting a stick handle and containing a channel along the lower edge of the blade. A string is fastened at one end to a puck and at the other end to a ball-shaped bead that is freely movable within the channel. The string attached to the bead extends outward from the channel through a slit that also extends along the length of the channel. During use, as the puck moves back-and-forth during stick-handling drills, the bead freely moves back-and-forth within the channel and the tether freely moves along the slit. An additional optional hole is provided at the top of the blade for use as an alternative stationary attachment of an elastic tether to the blade.

U.S. Pat. No. 6,796,915 discloses a dummy for practicing hockey checking composed of a base, an upper body, and a mechanism for controlling the dummy's motion. The generally cylindrical base has a foundation, an upwardly-extending column, and is weighted. The weight can be a solid weight or a removable material, such as sand or water, in a hollow container in the base. The upper body core is a column that slides onto or into the base column. A torso and a head is composed of a hard but resilient material. Rolled foam arms optionally have bendable wires for retaining the arms in a desired position. The upper body is covered with standard hockey clothing and equipment and a stick is secured to the gloves. The height of the dummy is adjustably by sliding and locking the base and upper body columns relative to each other. The undersurface of the base is smooth or has wheels or knobs in order to easily slide along the playing surface. A control grip controls motion of the dummy, and include a pair of hand loops attached to the back of the upper body, a rigid bar pivotally mounted to the back of the upper body, or an elongated rod connected to the base by a ball and socket joint.

U.S. Pat. No. 6,846,252 discloses a portable practice hockey device for practicing hockey on any smooth surface has a carrying handle and puck support cups for supporting a plurality of hockey pucks during practice. The device may be used on a driveway or the street for slapping a puck into a net. The device is made of synthetic ice and has chamfered edges such that a puck exits the surface at high speed and into the net. The practice device further provides a testing surface for hockey sticks prior to play on ice.

U.S. Pat. No. 6,899,633 discloses an apparatus for generating an acoustic profile representing the acceleration pattern of an object moving through a path of travel. The apparatus comprises a flute assembly attachable to a golf club. Preferably, the flute assembly comprises three cross flutes with three different fundamental frequencies aligned axially on the shaft of the club. The swinging motion of the club creates a complex, multi-tone acoustic profile indicative of the acceleration pattern of the club throughout the down swing. The golfer can then compare his profile to the swing of a known, great golfer, and then practice until he duplicates the sound of the model swing. While the apparatus is especially useful for golfers, the apparatus may be adapted to a wide variety of other sports implements, such as baseball bats, hockey sticks and tennis rackets, for example. An assembly comprising the apparatus in combination with the sports implement is also provided.

U.S. Pat. No. 6,939,273 discloses a weight training device 10 has removable weights 40, 42, 44, 46 to change the total weight added to the hockey stick 66 to adapt to the skills and capabilities of a player. Pockets 32, 34, 36, 38 are formed in the weight training device 10 to hold the weights 40, 42, 44,46 along the rectangular sides 75, 77 of the hockey stick 66. A compressible membrane flap 48 is attached to retain the weights 40, 42, 44, 46 in the pockets 32, 34, 36, 38 and to provide some adhesion to the hockey stick 66 3 to prevent the device 10 from moving on the hockey stick 66.

U.S. Pat. No. 6,976,272 discloses a universal visual shield apparatus, for use with a hockey helmet, is usable for training hockey players by partially blocking a user's field of vision. The apparatus includes a main shield body formed from an elastically deformable material, and is attachable to the helmet using connectors. The main shield body includes a horizontal floor portion and a vertical edge portion that cooperate to block a user from seeing the puck while it is in the user's possession, while still allowing the user to see forward. When worn, the apparatus forces the user to look forward, beyond the puck and stick. The apparatus may include adjustable apparatus straps, and can be used on any sized helmet without modifying the helmet or the apparatus. Because the apparatus is soft and crushable, the apparatus will not harm the user or another player if they are involved in a collision on the ice.

U.S. Pat. No. 7,357,740 discloses hockey pucks modified for training purposes and methods of using same. The pucks are intended to develop the visual acuity and hand-eye coordination of hockey players to improve game play. In one embodiment of the invention, each training puck is partially or entirely white (or some other light color) on its upper and lower flat surfaces, or on its circumferential side surface, or both. For example, the upper and lower surfaces may include a first relatively light portion around the periphery thereof and a relatively dark portion in a central region thereof. The relative size of the light and dark portions varies from puck to puck. In one embodiment the light portions are white and the dark portions are black. In use, players could begin by using a training puck with a relatively large dark portion. After they become accustomed to such a training puck, a puck with a smaller diameter dark portion could be substituted. This process would continue until pucks with very small dark portions were used. Finally, a completely light colored puck could be used. The smaller the size of the dark portions, the more difficult the puck will be to see on the ice or other light colored surface. Thus, by using the training pucks of the invention, players are required to increase their levels of concentration and visualization. When the players then revert to using regulation black pucks during hockey games, they are able to stick handle and pass the puck with enhanced ability and accuracy. The training pucks could sold or used separately or as part of a training kit comprising multiple pucks of varying appearance. Pucks adapted for training both skaters and goaltenders are described.

U.S. Pat. No. 7,593,775 discloses a method and apparatus include a therapeutic or developmental instrument that includes hardware and/or software for stimulating a muscle. Such an instrument may comprise, for instance, a golf club, a baseball bat, a lacrosse stick, a tennis racquet or a hockey stick, among other sports-related instruments. Still other suitable instruments may include a writing instrument, such as a pen. In the case of a golf club, a muscle of a user may be stimulated by the instrument as the golfer practices her swing. Combining such muscle stimulation with the act of practicing the movement of the swing has a synergistic effect of training the muscle as it builds strength. Similarly, a partial paralytic may regain strength in their hand by holding and writing with a pen configured to transcutaneously deliver a stimulating signal. Where desired, the instrument may include at least one electrode configured to deliver a stimulating signal to the holder of the instrument. In another or the same embodiment, wired electrodes may extend from the instrument or an adjacent signal generator to the holder of the instrument. This configuration may allow other, targeted muscles to be concurrently stimulated while the user manipulates the instrument.

U.S. Pat. No. 7,621,829 discloses a training device that is able to condition a hockey goalie in the proper placement of his hand and index finger for effectively controlling a hockey stick. The training device includes a strap adapted to be fitted around the top of a paddle of the goalie's hockey stick, and a finger channel vertically affixed to the strap and positioned for removable holding his index finger so that the index finger is substantially pointed down the paddle of the goalie hockey stick when he is holding the goalie hockey stick.

U.S. Pat. No. 7,815,532 discloses a practice hockey puck to be used by a young player to learn how to pick up a hockey puck off the ice with the blade of his hockey stick or to stickhandle on pavement or asphalt. The puck is like an ordinary puck but with a lower, outer, annular portion removed, thereby moving the outer peripheral edge of the bottom surface of the puck inwardly from the outer peripheral edge of the top portion of the puck. The outer peripheral edge of the bottom surface acts as a pivot edge. A portion of the puck lies outside this pivot edge. Pressing on this portion of the puck with the blade of the stick allows the player to easily pivot the puck about the pivot edge onto its side starting the process of picking the puck up with the stick. When the practice puck is inverted it can be used to practice stickhandling on a non-ice surface such as pavement or asphalt. The puck, in its inverted position, is contacted by the stick at a lower height on the puck making it less easy to tilt or tumble than a regular puck and thus easier to stickhandle on a difficult surface.

U.S. Pat. No. 7,857,717 discloses a hockey stick for training a person in stick handling, having elongate upper stick portion, an elongate lower stick portion, an elongate coupling member, and an elongate middle stick portion. The elongate upper stick portion is configured to be gripped by a control hand of the person. The elongate lower stick portion has, a blade member extending outwardly therefrom. The elongate coupling member rigidly couples the upper stick portion to the lower stick portion. The elongate middle stick portion is positioned between and collinear with the upper stick portion and the lower stick portion and is configured to be gripped by a directional hand of the person. The middle stick portion is rotatably coupled to the elongate coupling member so that rotation of the upper stick portion causes the lower stick portion and the blade member to rotate without rotating the middle stick portion gripped by the directional hand.

U.S. Pat. No. 7,867,112 discloses an athletic training apparatus for improving the stick and ball handling ability of an athlete and particularly an ice hockey player. The athletic training apparatus generally includes a body member having an upper surface, a flat bottom surface, and a generally circular side wall, wherein the body member is comprised of a cylindrical shape and at least one elongated attachment member extending below the bottom surface of the body member to affix the body member to an athletic training surface, such as a sheet of ice for ice hockey training. Pads may also be secured to the attachment member below the bottom surface of the body member for providing a gripping structure to secure the body member to a surface, such as a roller hockey playing surface. Alternate uses may be employed, such as use upon a court to improve ball handling skills and various other playing surfaces.

U.S. Pat. No. 7,905,800 discloses a hockey shooting training device comprises an elongate track and a carriage having a puck shaped an engaging member supported thereon for engagement by a hockey stick to be displaced along the track with the carriage from a starting end to a target end. Wheels on the carriage have a resilient peripheral surface for rolling along the track. A tether coupled to the carriage is wound onto a spool at the starting end of the track. Constant frictional resistance is applied to the spool during displacement of the carriage towards the target end as the tether unwinds from the spool. A winding mechanism on the spool returns the carriage to the starting end. An illuminated indicator extends along the track to provide visual guidance of the path of the carriage. A further indicator may indicate an angular offset of the engaging member from a central position about an upright axis.

U.S. Pat. No. 8,251,877 discloses systems and methods for functional training exercises having a function-specific user interface are disclosed. In one embodiment, an exercise assembly for performing a functional training exercise that simulates an activity involving a hand-held device includes a load, a support assembly, and a force-transferring assembly. A user interface includes a handle configured to resemble at least a portion of the hand-held device that is grasped by a user. An interface coupling assembly pivotably couples the handle and the force-transferring assembly. A training force applied to the handle by the user during movement of the handle along a functional training path induces an associated force on the load. In particular embodiments, the handle is configured to resemble a golf club, a baseball bat, a racquet, a hockey stick, and a sporting device configured to be thrown, such as a baseball.

SUMMARY

An hockey skill training system, said system comprising a hockey stick having a transverse bore, a movable stand, and a skill training device, said skill training device comprising: a generally cylindrical external shape having a top surface, a bottom surface, a front, and a back, wherein the bottom surface comprises an open portion adapted for releasably rigidly connecting said bottom portion of said training device on top of the stand, and wherein the top surface is upwardly slanted from the front to the back and wherein the top surface further comprises a generally centrally located channel disposed along the top surface between the front and back of the training device thereby forming a first and a second upwardly extending protrusion; wherein the first protrusion comprises a slanted surface that is generally parallel to the trough of the channel and a transverse bore having a longitudinal axis that is perpendicular to the channel; wherein the second protrusion comprises a slanted surface that is generally parallel to the trough of the channel and a transverse bore having a longitudinal axis that is perpendicular to the channel; wherein the transverse bore of the first protrusion and the transverse bore of the second protrusion are generally collinear; and a connecting rod for connecting hockey stick via the transverse bore of the hockey stick, wherein the rod is disposed through the transverse bore of the first protrusion, through the transverse bore of the training implement, across the channel, and through the transverse bore of the second protrusion, said rod comprising means for releasably retaining the rod within the transverse bore of the first protrusion and the transverse bore of the second protrusion.

BRIEF DESCRIPTION OF THE DRAWINGS

The present invention will be understood more fully from the detailed description given hereinafter and from the accompanying drawings of the preferred embodiment of the present invention, which, however, should not be taken to limit the invention, but are for explanation and understanding only.

DETAILED DESCRIPTION OF THE EMBODIMENTS

Figures 1, 2, 3, 4, 5, 6, 7:
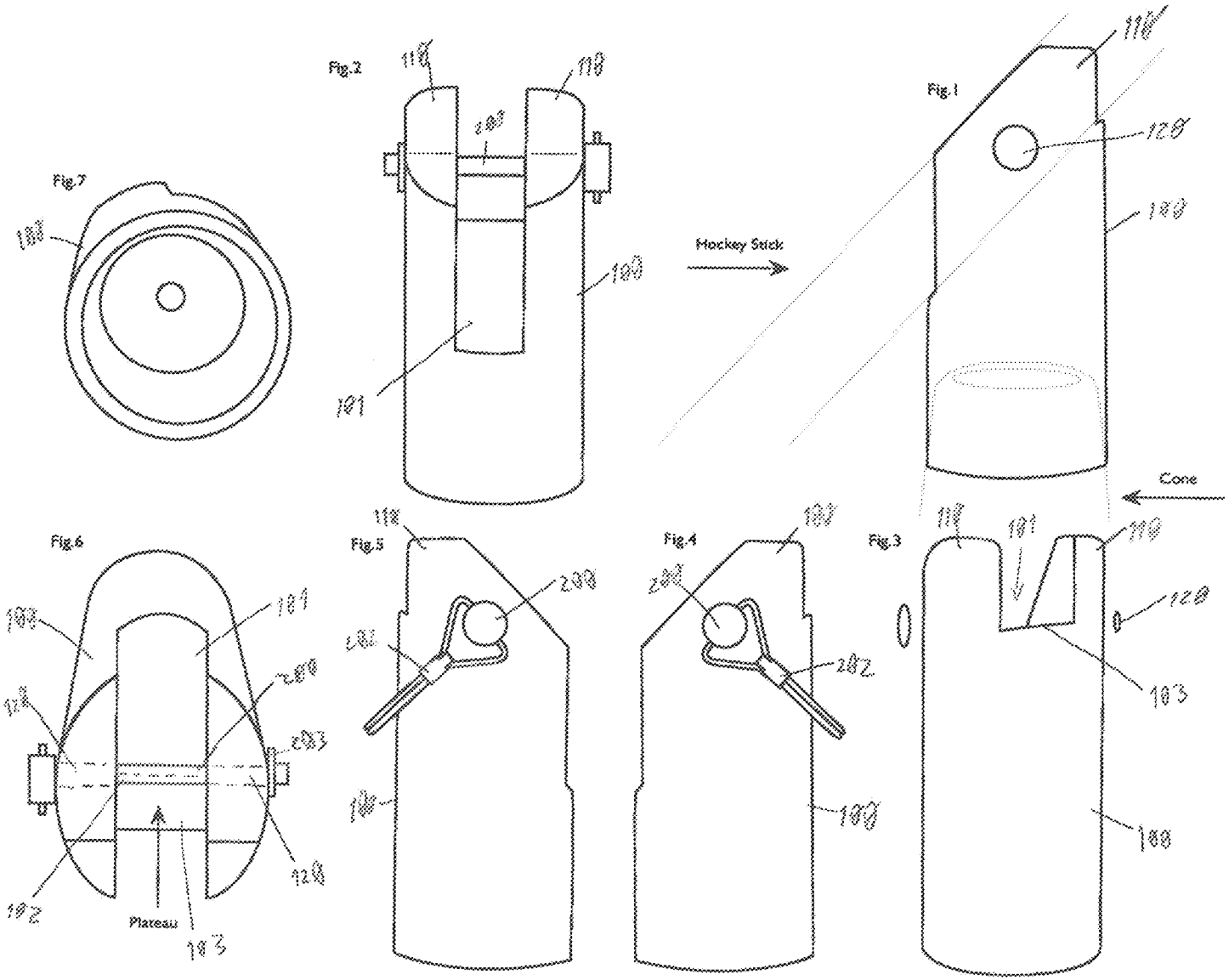
FIG. 1 shows a side view of a training apparatus according to the present invention, where the training device is attached to a hockey stick.
FIG. 2 shows a front view of a training device according to the present invention.
FIG. 3 shows a rear perspective view of a training device according to the present invention.
FIG. 4 shows a side elevation view of a training device according to the present invention.
FIG. 5 shows an opposing side elevation view of a training device according to the present invention.
FIG. 6 shows a top view of a training device according to the present invention.
FIG. 7 shows a bottom view of a training device according to the present invention.

The present invention will be discussed hereinafter in detail in terms of the preferred embodiment according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscuring of the present invention.

Referring first to FIG. 1, there is shown hockey training system comprising hockey training apparatus 100 hingedly attached to a common hockey stick. As further illustrated in FIG. 1 and explained in further detail below, hockey training apparatus 100 is preferably adapted to be placed on top of a common pylon. However, those of skill in the art will appreciate that hockey training apparatus might be used independently or placed on top of other types of stands or taller stands as desired.

Referring now to FIG. 2, there is shown a front view of training apparatus 100 according to the present invention. Training apparatus 100 comprises a generally cylindrical shape. Training apparatus 100 preferably comprises a hard thermoset, thermoplastic, rubber polymer, wood, composite, or light metal, such as aluminium.

As further illustrated in FIG. 2, training apparatus 100 further comprises a notched top surface forming channel 101 therein, where channel 101 within the top surface is slanted upwardly from the front (FIG. 2) to the back (FIG. 3) at an angle of between 30 degrees and 60 degrees, but preferably about 45 degrees. Channel 101 further comprises an upper plateau 103 such that a pivot point 102 exists between channel 101 and plateau 103.

Referring still to FIG. 2, channel 101 within the top surface of training apparatus 100 creates parallel protrusions 110 which extend upwardly from the top of training apparatus 100. Each protrusion 110 further comprises a transverse bore 120. The horizontal axis of bores 120 are collinear such that rod 200 can extend through each bore 120 and across the top of training apparatus 100.

Referring now to FIG. 3, there is shown a rear view of training apparatus 100 according to the present invention. Again, training apparatus 100 comprises a generally cylindrical shape and a notched top surface thereby forming a channel such that the top surface comprises upwardly extending protrusions 110. Each upwardly extending protrusion 110 comprises transverse bore 120. The longitudinal axis of the pair of transverse bores 120 are collinear and traverse the notch at the top of training apparatus 100.

Referring now to FIG. 4, there is shown a side elevation view of training apparatus 100 according to the present invention. As shown in FIG. 4, training apparatus 100 comprises a generally cylindrical shape. Training apparatus 100 further comprises a notched top surface forming a channel therein, where the channel slants upwardly from the front (FIG. 2) to the back (FIG. 3) at an angle of between 30 degrees and 60 degrees, but preferably about 45 degrees.

Referring again to FIG. 4, the notched top surface of training apparatus 100 creates parallel protrusions 110 (one shown) which extend upwardly from the top of training apparatus 100. Each protrusion 110 further comprises a transverse bore 120. The horizontal axis of bores 120 are collinear such that rod 200 can extend through each bore 120 and across the top of training apparatus 100.

Training apparatus 100 further comprises means to retain rod 200 within bores 120 of protrusions 110. In an exemplary embodiment of the present invention, means comprises a handle 202 attached to one end of rod 200 to prevent rod 200 from sliding completely through either bore 120.

Referring now to FIG. 5, there is shown a side elevation view of training apparatus 100 according to the present invention. As shown in FIG. 5, training apparatus 100 comprises a generally cylindrical shape. Training apparatus 100 further comprises a notched top surface forming a channel therein, where the channel slants upwardly from the front (FIG. 2) to the back (FIG. 3) at an angle of between 30 degrees and 60 degrees, but preferably about 45 degrees.

Referring again to FIG. 5, channel 101 of top surface of training apparatus 100 creates parallel protrusions 110 (one shown) which extend upwardly from the top of training apparatus 100. Each protrusion 110 further comprises a transverse bore 120. The horizontal axis of bores 120 are collinear such that rod 200 can extend through each bore 120 and across the top of training apparatus 100.

Training apparatus 100 further comprises means for retaining rod 200 within bores 120 of protrusions 110. In an exemplary embodiment of the present invention, means 201 comprises, as shown in FIG. 4, a handle 202 attached to one end of rod 200 to prevent rod 200 from sliding completely through either bore 120. Means for retaining rod 200 further comprises a removable pin 203 at an opposing end of rod 200. Removable pin 203 prevents rod 200 from sliding back through bores 120 after rod 200 is placed in a desired position.

Persons of skill in the art will appreciate that a variety of known means for retaining rod 200 within bores 120 of protrusions 110 might be employed. Such means include, for example, threaded nuts, larger in diameter than the area of bore 120, attached to one or both ends of rod 200; cotter pins attached to one or both ends of rod 200; or collapsible detents extending from one or both ends of rod 200.

Referring now to FIG. 6, there is shown a top view of training apparatus 100 according to the present invention. Training apparatus 100 further comprises a notched top surface forming channel 101 therein, where the channel slants upwardly from the front (FIG. 2) to the back (FIG. 3) at an angle of between 30 degrees and 60 degrees, but preferably about 45 degrees. Channel 101 further comprises upper plateau 103 such that pivot point 102 exists between channel 101 and plateau 103.

Referring again to FIG. 5, the channel of top surface of training apparatus 100 creates parallel protrusions 110 which extend upwardly from the top of training apparatus 100. Each protrusion 110 further comprises a transverse bore 120. The horizontal axis of bores 120 are collinear such that rod 200 can extend through each bore 120 and across the top of training apparatus 100.

Training apparatus 100 further comprises means for retaining rod 200 within bores 120 of protrusions 110. In an exemplary embodiment of the present invention, means 201 comprises, as shown in FIG. 4, a handle 202 attached to one end of rod 200 to prevent rod 200 from sliding completely through either bore 120. Means for retaining rod 200 further comprises a removable pin 203 at an opposing end of rod 200. Removable pin 203 prevents rod 200 from sliding back through bores 120 after rod 200 is placed in a desired position.

Referring now to FIG. 7, there is shown a bottom view of training apparatus 100 according to the present invention. As shown in FIG. 7, the bottom of training apparatus 100 preferably comprises void 130 to allow training apparatus 100 to be placed on top of a pylon or other stand. Pylons are the preferred stand for hockey skill training as such pylons are inexpensive, readily available, and won't damage the ice when used on a hockey rink.

Preferably void 130 of training apparatus 100 comprises a conical shape such that void 130 forms a complimentary connection to the top of a pylon as shown in FIG. 1. However, those of skill in the art will appreciate that apparatus 100 could be adapted to fit on any desired stand or to function on its own.

Referring again to FIG. 1, there is shown a common hockey stick having at least one (possibly several) transverse hole through which rod 200 of training apparatus 100 may be placed. Thus, as illustrated in FIG. 1, training apparatus 100 can hold a stick in a desired position within the notch of training apparatus 100. In this manner, the hockey stick can simulate a defensive player around which a user of the present invention may practice a variety of hockey training exercises.

It will be further understood by those of skill in the art of sports training that the present invention, although presently described in relationship to hockey training, might be easily adapted to other sports that utilize a stick and ball or puck, such as lacrosse, field hockey, and roller hockey or other field sports such as soccer or rugby. Indeed, it should be understood that the above description is of an exemplary embodiment of the invention and included for illustrative purposes only. The description of the exemplary embodiment is not meant to be limiting of the invention. A person of ordinary skill in the field of the invention or the relevant technical art will understand that variations of the invention are included within the scope of the claims.

The invention claimed is:

1. An athletic skill training system, said system comprising:

a sporting implement having a transverse bore; and an implement holding device, said holding device comprising:

a generally cylindrical shape having a top surface, said top surface comprising an upward slant from the front to the back and wherein the top surface further comprises a generally centrally located channel disposed along the top surface between the front and back of the training device thereby forming a first and a second upwardly extending protrusions, wherein the first protrusion comprises a transverse bore having a longitudinal axis that is perpendicular to the channel, wherein the second protrusion comprises a transverse bore having a longitudinal axis that is perpendicular to the channel, and wherein the longitudinal axis of the transverse bore of the first protrusion and the longitudinal axis of the transverse bore of the second protrusion are generally collinear;

a connecting rod for connecting the sporting implement through the transverse bore of the sporting implement, wherein the rod is inserted through the transverse bore of the first protrusion, through the transverse bore of the sporting implement, across the channel, and through the transverse bore of the second protrusion; and means for releasably retaining the rod generally in place between the transverse bore of the first protrusion and the transverse bore of the second protrusion wherein the implement is a device selected from the group consisting of a hockey stick, a lacrosse stick, and a field hockey stick.

2. The system of claim 1, wherein the holding device comprises a material selected from the group consisting of thermoplastic polymer, thermoset polymer, composite, aluminum, and wood.

3. The system of claim 1, wherein the channel of the holding device is formed at an angle of 30 degrees.

4. The system of claim 1, wherein the channel of the holding device is formed at an angle of 45 degrees.

5. The system of claim 1, wherein the channel of the holding device is formed at an angle of 60 degrees.

6. The system of claim 1, wherein the holding device has a height of between about 4 inches and about 12 inches.

7. The system of claim 1, wherein the holding device further comprises an upper plateau adjacent to the channel such that a pivot point exists between the channel and the plateau.

8. The system of claim 1, wherein the holding device comprises a generally uniform geometric shape selected from the group consisting of cylindrical, cubical, cuboidal, and pyramidal.

9. The system of claim 1, wherein the means for retaining the rod in place comprises a removable fastener placed at at least one of the opposing ends of the rod, said fastener selected from the group consisting of a transverse pin, a handle, a nut, a bolt, and a collapsible detent.

* * * * *